US008371992B2

(12) United States Patent
Irving et al.

(10) Patent No.: US 8,371,992 B2
(45) Date of Patent: Feb. 12, 2013

(54) BICYCLING EXERCISE APPARATUS

(75) Inventors: Colin Irving, Pacific Palisades, CA (US); John J. Harrington, Los Angeles, CA (US); Brian C. Stewart, Oregon, OR (US); Michael S. Lofgren, Tualatin, OR (US)

(73) Assignee: RealRyder, LLC, Santa Monica, CA (US)

( * ) Notice: Subject to any disclaimer, the term of this patent is extended or adjusted under 35 U.S.C. 154(b) by 0 days.

(21) Appl. No.: 13/066,497

(22) Filed: Apr. 15, 2011

(65) Prior Publication Data

US 2011/0195820 A1 Aug. 11, 2011

Related U.S. Application Data

(63) Continuation of application No. 11/893,634, filed on Aug. 17, 2007, now Pat. No. 7,927,258.

(51) Int. Cl.
*A63B 22/06* (2006.01)

(52) U.S. Cl. ..... 482/57

(58) Field of Classification Search ..... 482/51–65
See application file for complete search history.

(56) References Cited

U.S. PATENT DOCUMENTS

| | | | | |
|---|---|---|---|---|
| 5,016,870 | A * | 5/1991 | Bulloch et al. | 482/62 |
| 5,035,418 | A * | 7/1991 | Harabayashi | 482/62 |
| 6,648,802 | B2 * | 11/2003 | Ware | 482/57 |
| 7,682,286 | B2 * | 3/2010 | Badarneh et al. | 482/5 |
| 7,963,889 | B2 * | 6/2011 | Badarneh et al. | 482/57 |

* cited by examiner

*Primary Examiner* — Stephen Crow
(74) *Attorney, Agent, or Firm* — Smyrski Law Group, A P.C.

(57) ABSTRACT

An apparatus permitting a user to perform a simulated bicycling exercise is provided. The design includes a frame and a first mounting point and a second mounting point configured to maintain the frame. A seat is connected to the frame and configured to support the user. A wheel is positioned in association with said frame and pedals configured to interact with the wheel, and the frame is configured to pivot about the first mounting point and second mounting point in response to leaning by the user. Handlebars may be provided that enable further force application and enhance the leaning or pivoting in the bicycle riding simulation experience.

29 Claims, 9 Drawing Sheets

BICYCLING EXERCISE APPARATUS

This application is a continuation of co-pending U.S. patent application Ser. No. 11/893,634, entitled "Bicycling Exercise Apparatus," filed Aug. 17, 2007, inventors Colin Irving et al., the entirety of which is incorporated herein by reference.

BACKGROUND OF THE INVENTION

1. Field of the Invention

The present invention relates generally to the field of exercise equipment, and more specifically to exercise apparatus for aerobic, strength, balance, and skill training that permits a user to perform a simulated bicycling exercise.

2. Description of the Related Art

Cardio-pulmonary, cardiovascular, and strength training exercise equipment found in today's exercise and health centers as well as in the home seek to improve and maintain an individual's aerobic and strength fitness. Many types of exercise equipment, including treadmills, rowing machines, stationary bicycles, stair-stepping machines, skiing machines (cross country and alpine), and dry-land swimming machines are available for individuals who desire to maintain and improve their overall fitness and conditioning.

Stationary bicycles provide users a means for exercising certain muscles, generally involving the legs, and to a much lesser extent, if any, the center core, i.e. abdominal and lower torso muscles that help cyclist balance, arms and upper body muscles, i.e. biceps, triceps, oblique's and back. The current state of stationary bicycle designs have typically been limited to designs that affix a pair of handlebars, pedals, and seat to a single rigid platform, e.g. bolted in place and resting on a floor, configured to replicate only the spinning dynamic associated with pedaling a bicycle. In this arrangement, current designs are able to simulate only a very limited number of the total dynamic forces found when actually riding, for example a conventional bicycle, and situate the user in a fixed and unchanging posture unlike a conventional bicycle. Operating today's stationary bicycle in a fixed posture or position may lead to numbing of certain nerves in the rider's body as well as body parts close to the bicycle seat, such as the prostate, due to the seat contact pressures remaining relatively constant while riding the stationary bicycle.

The inability of today's stationary bicycle designs to replicate or simulate the actual dynamic forces exhibited while riding a conventional bicycle, also limits the number and type of muscle groups involved. These designs do not engage many of the muscles required to propel and balance a conventional bicycle, nor do such stationary bikes address certain core muscles in the rider's physique. Such stationary bicycles can be considered undesirable and generally inadequate for training by cycling enthusiasts and devoted competitors. Designs limited in this manner are unable to provide a simulation of the overall cycling experience and do not involve the muscle groups as found when riding a bike.

Other designs attempt to improve the simulation by involving the use of an existing conventional bicycle positioned on stationary rollers or on a stand where the rear tire does not make contact with the ground. Such a stand may employ a resistance mechanism, for example a magnetic trainer stand.

Stationary roller designs typically involve a conventional bicycle and a stationary cylindrical rolling mechanism where the rider first places the bicycle onto a series of rollers. Once the bicycle is properly positioned, the cyclist may mount and begin to pedal and balance the conventional bike. A major reason for the lack of popularity with stationary roller designs is that they are difficult to learn and master and can be dangerous to operate. Although designs of this type may offer additional comfort because the seat moves in relation to the contact area of the rear tire and rollers and may allow the torque from the pedals to influence the movement of the bike over the rollers, this arrangement remains undesirable because it does not relieve pressure on the seat contact area, i.e. "bike seat syndrome" including a numbing of nerves and body parts adjacent to or near the seat. The roller design does not allow the user to adequately lean and steer the bicycle while exercising.

Stand designs, including those employing the magnetic trainer, are similar in operation to current stationary bike designs and are subject to the same limitations found in roller and stationary designs.

Part of the issue with stationary bicycle designs involving a rolling mechanism is the act of mounting and beginning to pedal on a stationary roller design is quite different than starting a bicycle. Roller designs are also subject to having the entire bike wander, causing the user to lose balance or slipping off of the rollers. Since the rollers are typically positioned on a hard surface, such as a concrete floor as typically found in exercise and health centers, if the user loses balance at any point while performing the exercise, they typically will fall and impact the ground and are thus subjected to potential injuries.

In order for a cyclist to properly ride a conventional bicycle, the user must provide propulsion by spinning the pedals, steer by turning the handlebar to control the direction of the bicycle, and maintaining balance, i.e. lean, turn, stop, accelerate and de-accelerate, etc. Properly riding a bicycle requires a cyclist or user to apply numerous complex and dynamic turning and leaning forces at the handlebar, pedals, and seat, or any combination thereof simultaneously in multiple directions with varying intensities to balance, control, steer, and propel a bicycle. A cyclist may provide additional steering force to further control and direct the amount of roll and yaw, i.e. lean, tilt, etc., exhibited by the frame, for example during a turn by moving his hips to one side.

Today's stationary designs are unable to adequately respond to turning and leaning forces applied by the user at the pedals, handlebar, and seat. Roller designs remain difficult and dangerous to operate and are ill suited for usage in a group or class setting.

Current stationary bicycle designs tend to be relatively limited in that the user's only significant dynamic interaction with the apparatus occurs at the pedals, limiting the exercise simulation to the pedaling portion of the riding experience. Such designs are limited in the muscle groups involved and the quality of the spinning action that may be produced. Users of such devices would likely be interested in devices that simulate the overall cycling experience and desire to obtain the benefit of engaging a broader range of the muscle groups required to ride a conventional bicycle.

It would therefore be beneficial to provide a bicycle exercise apparatus that more accurately simulates the operation of a conventional bicycle and overcomes the limitations found in current stationary bicycle designs.

SUMMARY OF THE INVENTION

According to one aspect of the present design, there is provided an apparatus permitting a user to perform a simulated bicycling exercise. The design includes a frame with a first mounting point and a second mounting point configured to maintain the frame. A seat is connected to the frame and configured to support the user. A wheel is positioned in association with said frame and pedals configured to interact with the wheel, and the frame is configured to pivot about the first mounting point and second mounting point in response to leaning by the user. Handlebars may be provided that enable further force application and enhance the leaning or pivoting in the bicycle riding simulation experience.

These and other advantages of the present invention will become apparent to those skilled in the art from the following detailed description of the invention and the accompanying drawings.

DESCRIPTION OF THE DRAWINGS

The present invention is illustrated by way of example, and not by way of limitation, in the figures of the accompanying drawings in which.

DETAILED DESCRIPTION OF THE INVENTION

Figure 1:
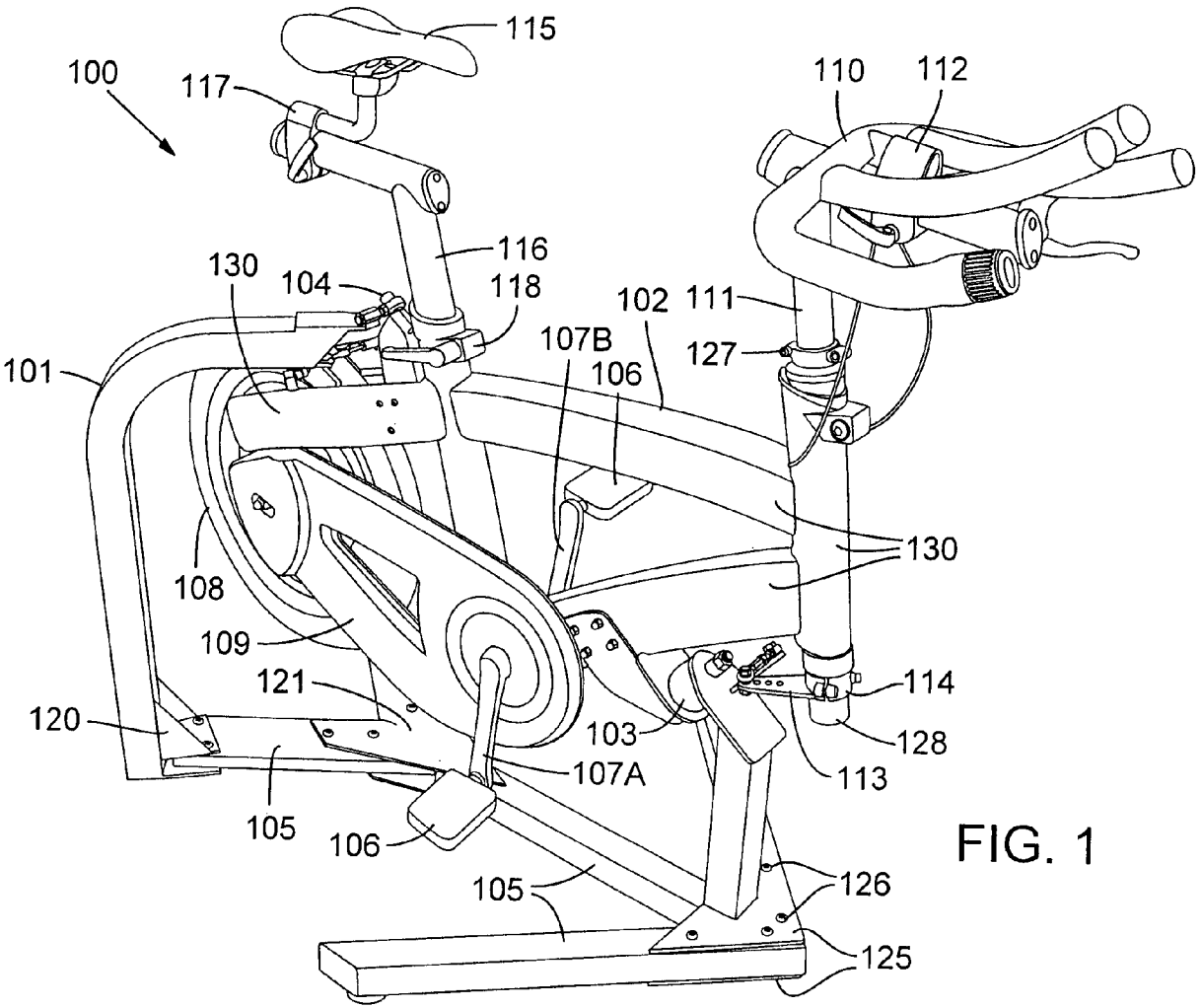
FIG. 1 is a right hand side perspective view of one embodiment of the present design.

The present design is a bicycling exercise apparatus, typically comprising a bicycle frame and components, i.e. handlebars, headset, pedals, seat, chain drive and flywheel, affixed to a stationary frame typically positioned on a smooth surface, e.g. hardwood or concrete floor, able to articulate or rotate about two mounting points. The mounting points are configured between the stationary frame and the bicycle frame and may allow a cyclist to move the entire frame and components left and right, and to lean the bicycle within the stationary frame in response to forces applied at the handlebars, pedals, and seat while the cyclist pedals or 'coasts' by not pedaling.

In essence, the front and rear mounting points suspend the bicycle frame in space, allowing the bicycle frame to articulate or rotate in the left and right directions and to lean the bicycle as a single articulating platform, more accurately simulating forces encountered when actually riding a bicycle. For example, in this arrangement the suspended bicycle frame may respond to torque generated by the cyclist pedaling resulting in the frame moving or leaning within the stationary frame. In a similar manner, the suspended bicycle frame may respond to forces directed by the cyclist applied at the handlebars, pedals, and seat that also cause the suspended bicycle frame to lean or move about in space within the stationary frame. For example, the cyclist may move his hips in a side-to-side motion where the applied forces at the seat result in the bicycle frame moving left-to-right or right-to-left to simulate turning the bicycle by the seat in a comparable manner to that exhibited by a conventional bike being propelled down a road.

In addition, the cyclist may operate the present design without hands, balancing and steering the bicycle using his hips to reposition his body mass in relation to the bicycle frame. Furthermore, the cyclist may rise from the seat, separating himself from the seat, shifting his body mass to the handlebar and pedals, while still pedaling and may throw his body weight from side to side to simulate climbing a hill, a technique frequently employed by competitive bicycle racers. The cyclist may generate forces by operating or spinning the pedals in this out-of-seat position in combination with the forces resulting from the spinning action of the flywheel element may produce a gyroscopic effect allowing the rear of the apparatus to 'wag' back and forth to simulate the actual behavior and operation of a conventional bike.

The bicycling exercise apparatus may include handlebars that turn with the bicycle, or the handlebars may be fixed or loose and free moving. The drive-line of the present design may be fixed, such that pedaling forward causes the flywheel to move in what would be considered a forward direction, on a conventional bicycle, while pedaling backward causes the flywheel to move in the opposite direction, or may be free in that pedaling forward causes the fly wheel to move while pedaling backward, i.e. free-wheeling, provides no resistance or force application to the flywheel. A lockout mechanism may be provided to fix the relationship between the stationary frame and bicycle frame that may allow the apparatus to operate and behave in accordance with current stationary bicycle designs.

Apparatus

Figure 2:
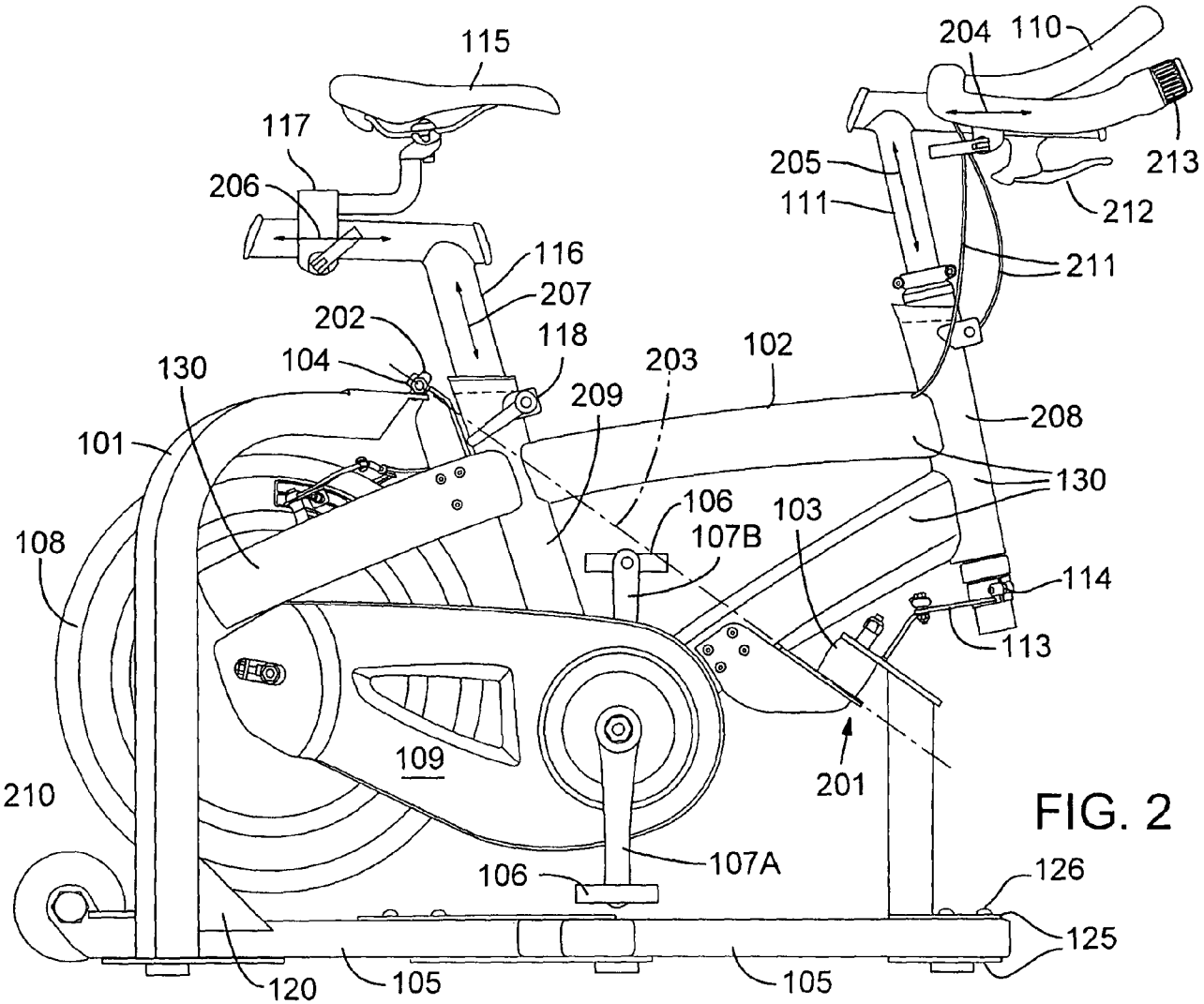
FIG. 2 is a side view illustrating the angular relationship formed between first mount and second mount about an axis in accordance to the present design.

The bicycling exercise apparatus is illustrated in FIGS. 1 and 2. In combination, these figures depict relationships between major assemblies and subassemblies of one embodiment of the present design.

FIG. 1 is a right hand side perspective view illustrating one aspect of the present design. Referring to FIG. 1, a bicycling exercise apparatus 100 may include a stationary frame 101 supporting a frame 102 arranged to support the user. The support mechanism may involve suspending frame 102 from two mounting points or attachment fixtures, wherein a first mount 103 is located below handlebar 110 and connects frame 102 to a front position located on stationary frame 101, and locates a second mount 104 below and behind seat 115 for the purpose of connecting frame 102 to a rear position located on stationary frame 101.

While this embodiment is shown with a floor mounted base, it should be understood that the first mount 103 and second mount 104 may be provided and oriented using any type of mounting structure reasonable under the circumstances. For example, while not shown here, the present design may have first and second mounting points connected to apparatus that suspends the frame 102 from a ceiling, or have the first mount 103 and second mount 104 mounted to apparatus resting on a floor or mounted to apparatus connected to a wall, ceiling, vehicle, or other reasonable position or apparatus available based on circumstances.

The bicycling exercise apparatus may include a variety of off-the-shelf parts, i.e. components, elements, devices, and combinations of individual components, to form sub-assemblies and complete assemblies used in constructing the present design. For example, the present design may include, and will be described for purposes of this disclosure, a stationary frame 101, frame 102, driveline, steering, and seating assemblies. Driveline, steering, and seating assemblies are generally known, and, for example, the driveline may be chain or belt driven or otherwise designed to effectuate the functionality described herein.

In general, the construction of the bicycling exercise apparatus is typically from metals, with other parts and components made from a variety of common materials, including but not limited to, aluminum alloys, carbon fiber, titanium, steel, composite materials, plastic, and wood and any combination thereof, to provide the functionality disclosed herein. Other materials may be employed in order to manufacture the parts and components to form assemblies used to construct the bicycling exercise apparatus in accordance with the present design.

From FIG. 1, the present design's stationary frame 101 or base or base assembly may be constructed of multiple sections of formed steel wherein sections 105 are attached at a connection point typically using at least one steel flange or bracket component. For example, FIG. 1 illustrates a top flange and a bottom flange at point 125, and at least one bolt, nut, and washer assembly point 126, or other assembly means, e.g. welding, sufficient to secure one or more sections 105 when mated to the top and bottom flanges at point 125. Another type of attachment component may include a 90-degree elbow bracket at point 120, flat bracket at point 121, and other style/shape bracket suitable for fulfilling the purposes of the securing one or more sections 105 when mated or joined to one another. Although the construction technique described herein uses multiple sections, brackets, and flanges, forming stationary frame 101 may entail providing a single piece having all the functionality described. In general, the base or base assembly is required to support the frame and enable the user or rider to pedal, lean and effectuate the functionality discussed herein, and may differ from the assembly pictured.

FIG. 1 illustrates the construction of the present design's frame 102 or frame assembly, involving multiple frame tubing elements of formed steel, e.g. top tube, down tube, head tube, seat tube, chain stay and seat stay. Tubing elements 130 are typically attached by gluing or welding seams formed where two or more tubing elements are brought together to form frame 102 or other means sufficient to secure tubing elements 130 of the frame when mated in accordance with the present design.

The top tube connects the head tube to the seat tube at the top, the down tube connects the head tube to the bottom bracket shell, the head tube contains the headset and connects the top tube to the down tube, the seat tube contains the seat post and supports the seat and connects the top tube to the bottom bracket shell, the chain stays run parallel to the chain and connects the bottom bracket shell to the rear dropouts, and the seat stays connect the top of the seat tube to the rear dropouts. The tube terminology used to describe the construction of the present design should be well understood by those skilled in the art.

The present design may attach the driveline assembly 109 to frame 102. The drive-line assembly 109 may support the pedals and provide a place to position feet and may assist the user in maintaining balance of frame 102 suspended within the stationary frame 101 while performing the simulated bicycling exercise. The driveline assembly 109 may comprise a pedal and flywheel sub-assembly arrangement. The pedal sub-assembly may include pedals 106 to provide the user a place to position her feet, a crank-arm 107 to attach the pedals 106 to a chain-ring and a bottom bracket bearing component (not shown) and may connect a first crank-arm 107A to a second crank-arm 107B component. The flywheel sub-assembly may include a fixed gear component (not shown) securely mounted and attached to flywheel 108. The fixed, i.e. single, gear may optionally be replaced with a cluster of gears (e.g. cassette), with appropriate shifting mechanism components allowing the user to change the amount of spinning resistance experienced while pedaling.

A chain or belt component (not shown) may transmit forces applied by the user spinning pedals 106 from the pedal sub-assembly to the flywheel sub-assembly. The chain or belt component is typically configured to mate or connect a front chain-ring component to the rear fixed gear component by positioning the chain over the front chain-ring and over the fixed single gear, or optionally a cluster of gears, and affixing a key link (not shown) to form a single continuous chain loop, and such a design is generally known within the art. A cover atop the driveline assembly 109 for purposes of protecting the user during operation and affording access to service the driveline components previously described may cover the chain, chain-ring, and fixed gear components. The present design may involve a free-wheel assembly or direct drive assembly along with the chain, chain-ring, and associated chain-drive components within driveline assembly 109 to operate or spin flywheel 108.

The present design may attach the steering assembly at the front of frame 102 as illustrated in FIG. 1. The steering assembly may support the handlebar component allowing users a place to position their hands and to assist the user in maintaining balance of frame 102 suspended within stationary frame 101 while performing the simulated bicycling exercise. The steering assembly handlebar 110 component typically is fitted with handgrips or tape for grasping by users to 'steer' the present design and my be used in combination with the drive-line assembly 109 to assist the user in maintaining balance while spinning the pedals to perform the simulated bicycling exercise.

Handlebar 110 is typically fixed at one end of stem 111 by tightening a clamp mechanism at 112. For purposes of simplicity, stem 111 is illustrated as passing through the top of head-tube frame element and protruding out at the bottom of the frame element. The other end of stem 111 may attach to an adjustable swing-arm 113 device, wherein swing-arm 113 may be set to a fixed position by tightening an adjustable collar at 114.

The bicycling exercise apparatus 100 may employ a conventional headset arrangement to attach stem 111 to a steering-connector tube 128, positioned through the head-tube, via an adjustable clamp 127 in accordance with an aspect of the present design. In this arrangement, the other end of steering-connector tube 128 may attach to an adjustable swing-arm 113 device, wherein swing-arm 113 may be set to a fixed position by tightening an adjustable collar at 114.

Continuing on, stem 111 may be arranged to couple user applied dynamic steering forces input at handlebar 110 and transferring these forces received at handlebar 110 to first mount 103. While the majority of the forces may be transferred to the first mount from stem 111 or steering-connector tube 128, small forces may also be transferred to second mount 104.

The present design may attach the seating assembly above driveline assembly 109 located at the down-tube frame element of frame 102 as illustrated in FIG. 1. The seating assembly may support seat 115, or saddle, and may provide users a place to position and contact their upper legs and core to assist in maintaining balance of frame 102 suspended within stationary frame 101, in accordance with the present design, while performing the simulated bicycling exercise. The seating assembly may include seat 115 fixed to seat post 116 sufficient to provide a sitting posture that may allow a user to properly position their body over frame 102 and afford additional steering force inputs to further lean and turn frame 102 in accordance with one aspect of the present design.

The seating assembly may be used in combination with the driveline assembly 109 and steering assemblies to assist the user in maintaining balance while spinning the pedals to perform the simulated bicycling exercise. The present design may fix seat 115 to one end of seat post 116 by tightening a clamping mechanism at 117. The other end of seat post 116 is typically fixed to the down tube frame element portion of frame 102 by tightening an adjustable collar at 118. The bicycling exercise apparatus may arrange seat post 116 to couple dynamic steering inputs applied at seat 115 by the user and transfer these forces to second mount 104. Again, while most of the forces may be transferred to the second mount from the seat post, small forces may also be transferred to first mount 103.

The coupling arrangement and transfer of forces from handlebar 110, pedals 106, and seat 115 will be further described in later sections.

FIG. 2 is a side view illustrating the angular relationship formed between first mount 103 and second mount 104 along axis 203 in accordance to the present design. First mount 103 may include an elastomer spring 201 device to attach and suspend frame 102 within stationary frame 101 at a front location in accordance with one aspect of the present design. The second mount 104 may include a pivot ball joint 202 device to attach and suspend frame 102 within stationary frame 101 at a rear location in accordance with another aspect of the present design.

The elastomer spring shown is associated with the front lower mounting point, but such a device or similar device may be employed with the upper mounting point (second mount 104) or lower mounting point (first mount point 103) or both. Further, while the orientation of the mounting points is shown to be at different predetermined distances above a surface such as a floor or stand or flat ground, it is to be understood that functionality described herein may be achieved when the mounting points and axis formed thereby are at varying values, including horizontal.

The two mounting points in conjunction with user inputs provided at handlebar 110, pedals 106, and seat 115, may permit an off-axis tilting or articulating about axis 203 of frame 102 within stationary frame 101. The ability to tilt, lean, and/or roll and yaw the bicycle frame in an off-axis manner is not available in today's stationary exercise bike state of design. The ability to articulate and rotate the frame 102 within the space defined by the mounting points affixed to the stationary frame may provide a significantly more accurate simulation of riding a bicycle. The accurate simulation realized by operating the present design may involve exercising and training muscle groups not involved when operating today's stationary exercise bicycling designs.

Frame 102 first mount suspension technique may employ an elastomer spring 201. However, this mount may include a hydraulic strut or other assembly suitable for providing the suspension and spring component in accordance with the present design. Second mount 104 may involve a pivoting ball joint 202 assembly to form a rear suspension point for frame 102. In general, the ball joint assembly may be configured to connect frame 102 to stationary frame 101. The ball joint design may include a bearing stud and socket enclosed in a casing (not shown), typically constructed from steel. In one embodiment, the casing enclosing the socket may provide a mounting arrangement allowing the casing to be attached and fixed to frame 102. The ball joint bearing generally rides inside the casing and may support a threaded stud configuration. The threaded stud may pass through stationary frame 101 secured or fastened with a washer and nut arrangement. The ball joint 202 may be configured to suspend frame 102 and permit a pivoting movement within a well defined semicircle established by stationary frame 101 at the second mounting point. The present design is not limited to using a ball joint 202 at the second mounting point, and may use any device or component that enables a range of motion or pivoting around the mounting point. Use and assembly of ball joint devices configured to suspend one part from another part should be well understood by those skilled in the art. The first and second mounting points may involve elastomer bushings with bolts passing therethrough, or involve a ball and socket device. In a further embodiment, the first and second mounting points may involve spherical rod ends, or a sleeve with a tube extending through each sleeve.

The term "elastomer" as employed herein is generally used to describe a material formed using vulcanized rubber, but other resistive materials may be employed as the resistive element, again in the orientation or arrangement shown or in other arrangements (e.g. proximate the upper and/or lower mounting points) and the term elastomer is not intended to be limiting. Actual elastomer materials may allow considerable motion when subjected to external forces. In general, elastomer materials are characterized by their ability deform when subjected to external forces and then return to their original shape when the external forces are not present. The ability to flex or deform and return to their original shape may provide a spring like resistance effect. The resulting spring effect exhibited at the first mount and the pivot motion exhibited at the second mount, when aligned along axis 203 and combined with the assemblies previously describe may permit the user to roll and yaw frame 102 and simulate turning on an angle, i.e. resulting from the user leaning, turning, and combinations thereof, while simultaneously generating a steering effect emulating 'feedback from the road' while spinning the pedals to perform a simulated bicycling exercise. The spring like resistance effect may involve any type of spring device suitable for performing the functions of the first or second mount by permitting frame 102 to return to a neutral position.

The term "roll", or bank angle, as employed herein is generally used to describe a rotation or pivoting around an axis termed the longitudinal axis, shown in the drawings as an axis drawn through the design from the handlebars to the seat in the direction the user faces. The term yaw is meant to define a rotation about the vertical axis, drawn from the top tube frame element to the bottom tube frame element, and perpendicular to the roll axis. The terms pivot, roll, yaw, lean, tilt are used in combination in this disclosure to describe horizontal and vertical movements, or angular offsets, of frame 102 within stationary frame 101 and about axes or components described. FIG. 2 illustrates the assembled version of bicycling exercise apparatus 100, including stationary frame 101, frame 102, drive-line, steering, seating, and mounting point assemblies, configured for permitting a user to operate pedals 106 in a circular spinning or rotating motion and arranged to assist the user in maintaining balance while performing the simulated bicycling exercise.

Handlebar 110 may receive forces originating from the users hands, e.g. turning left, and couples or transfers the forces through stem 111 to frame 102. In addition, forces may originate from the user pushing on one side of seat 115, e.g. pressing left upper leg or thigh region, and may transfer this force through seat post 116 to frame 102. Furthermore, pedals 106 may receive forces originating from the users feet, and may couple the forces through the driveline assembly 109 to frame 102. Forces received by frame 102 may be dissipated as a result of the suspended bicycle frame leaning, tilting, rolling, yawing or articulating around the elastomer spring 201 and pivot ball joint 202 mounting point devices and within the space defined by stationary frame 101.

Figure 3:
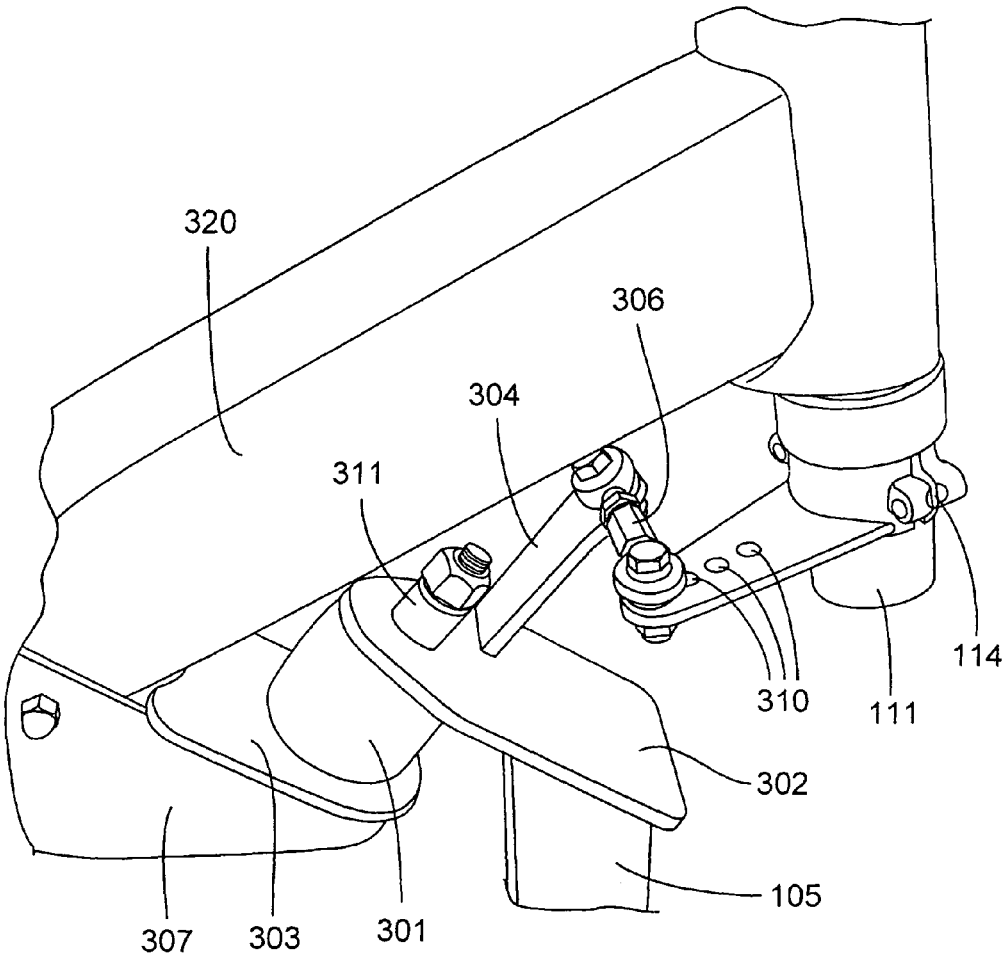
FIG. 3 is a close up view illustrating the first mount front suspension point mechanism involving an elastomer spring device attached to a steering input assembly employable with the present design.

The force dissipation mechanism between the frame 102 and stationary frame 101 may involve configuring an elastomer spring 201 mounting point device with a pivot ball joint 202 mounting device wherein the devices are positioned and aligned along axis 203 as illustrated in FIG. 2. The force transfer mechanism may enable the present design to transfer forces simultaneously applied by the user at the handlebar 110, pedals 106, and seat 115 and may allow the bicycling exercise apparatus to absorb, distribute and dissipate the forces originating from the user while spinning the pedals, turning the handlebar, and maintaining balance. In other words, the present design may translate forces applied at the handlebar, pedals, and seat into forces absorbed and dissipated by frame 102 in the form of roll and yaw resulting in a side to side motion of frame 102 relative to stationary frame 101. The bicycling exercise apparatus 100 components involved used to transfer forces from stem 111 and seat post 116 (not shown) to elastomer spring 201 are shown in FIG. 3 and discussed below.

FIG. 2 illustrates the present design configured to allow adjustment for user hand and seat positions relative to his feet or pedals and the angular relationship formed by the alignment of first mount 103 and second mount 104 about axis 203. The present design may permit handlebar 110 to move forward and backward at point 204 relative to head tube 208 and handlebar 110 may move up and down at point 205 by lengthening or shortening the amount of stem 111 exposed or protruding out of head tube 208 at adjustable clamp 127. In a similar manner, the present design may permit seat 115 to move forward and backward at 206 relative to seat tube 209 and seat 115 may move up or down at 207 by lengthening or shortening the amount of seat post 116 exposed or protruding out of seat tube 209. The ability to adjust or re-position the handlebar and seat may allow the user to modify the frame geometry and appropriately position their body mass relative to the frame to accommodate for different lengths of rider's arms and legs. Proper positioning of the user's body mass in relation to the two mounts aligned along axis 203 may enable tuning the present design's simulation to the user's size. Such tuning may include alteration of components shown and/or the elastomer employed.

The angular relationship formed along axis 203 where the first mount 103 and second mount 104 move about axis 203 may be described in association with a combination of horizontal and vertical components employed in the design. A horizontal offset component may result from frame 102 moving in the horizontal direction when measured from a resting or static position within the space established by stationary frame 101. A vertical offset component may result from frame 102 moving in the vertical direction when measured from the resting or static position within the space established by stationary frame 101. The resulting angular relationship, i.e. the amount of lean, tilt, roll and yaw or any combinations thereof, produced by user input, e.g. turning the handlebar and/or pressing a thigh into the seat, etc., may be described by dynamically changing horizontal and vertical offsets induced on frame 102.

Figure 6:
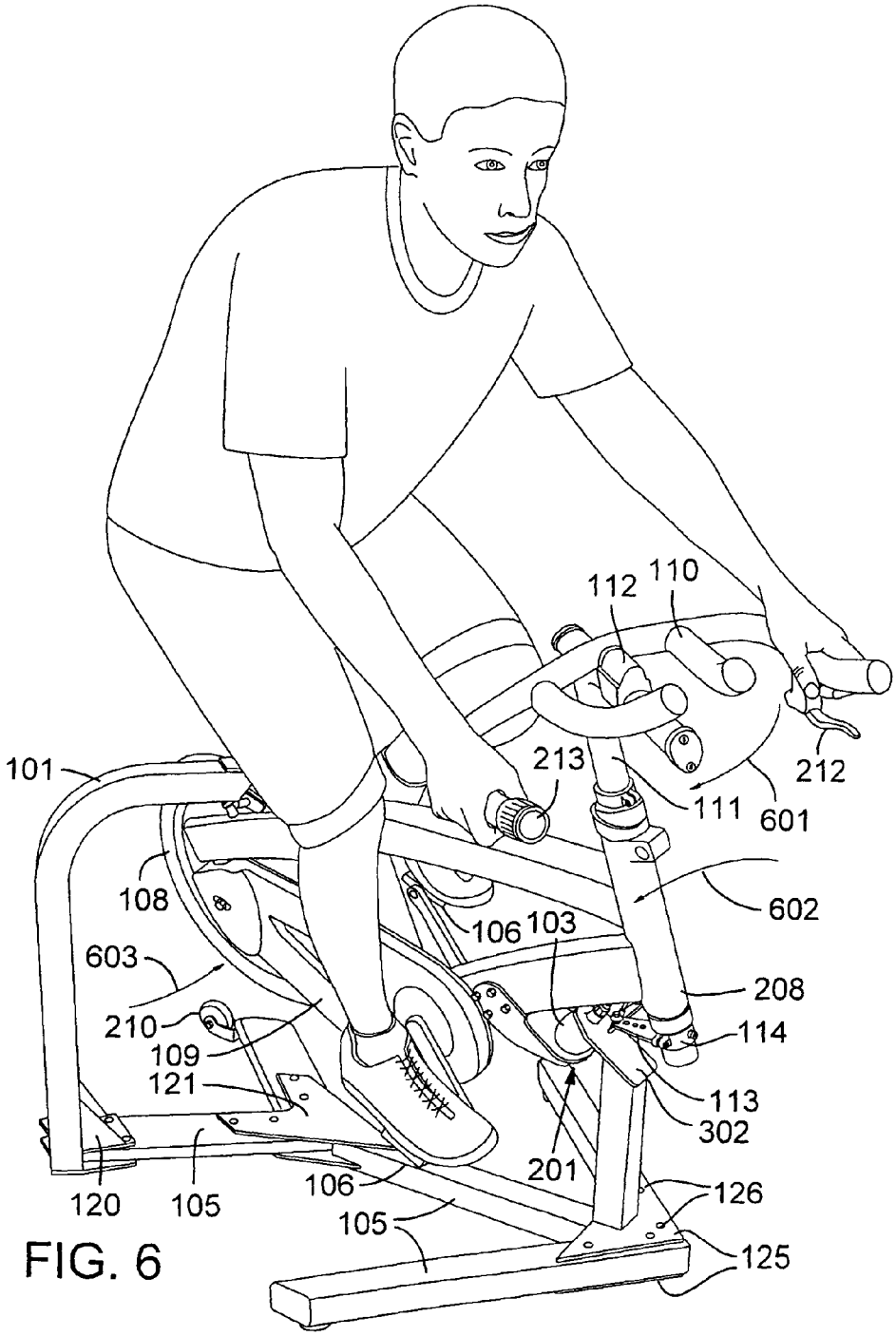
FIG. 6 is a right side perspective view of a user spinning the pedals in a right-turn position by simultaneously applying a complex steering input force at the handlebar, seat, and pedals producing a roll and yaw condition that affords articulation and rotation of the bicycle frame about a predefined axis in accordance with the embodiment shown.

The combination of these two angular offsets forms the angular relationship prescribing the movement in both spatial dimensions in accordance with one embodiment of the present design. Generally, as used herein, the term horizontal offset, i.e. roll, or other similar terminology, refers to directions in an orientation where the frame 102 lower portion, e.g. bottom bracket, is moving "in-towards-the-page" and "out-from-the-page" when compared to the top tube frame element as illustrated in FIG. 2. The term vertical offset, i.e. yaw, or other similar terminology, refers to directions in an orientation where the frame 102 front portion, e.g. head tube, is moving "left" or "right" when compared to frame 102 rear portion, e.g. the down tube frame element as illustrated in FIG. 2. The combined effect of the horizontal and vertical offsets generated by the present design is illustrated in FIG. 6.

Furthermore, the angular relationship formed between the two mounting points in conjunction with the mounting devices construction, e.g. elastomer spring 201 device and pivot ball joint 202 assembly, may produce a steering effect and allow for a change in tilt-to-turn ratio, i.e. articulating about the two mounting points, to closely simulate the experiences realized when operating a conventional bicycle. The tilt-to-turn ratio may result from the user moving the handlebar in combination with leaning against the seat, and lifting or pushing against the pedals. In this arrangement the present design may permit the user to simulate the tilt-to-turn on an angle as found when operating a conventional bicycle in a similar manner. The steering effect or force generated by the present design may provide a realistic "feedback from the road" as simulation information, delivered as counter-forces received by the user at the handlebar, seat, and pedals. The user may process simulation information generated by the present design to determine the amount and duration of required forces, provided as input to the handlebar, pedals, and seat, as continuous adjustments in a manner sufficient to control and maintain balance while performing the simulated bicycling exercise.

This orientation is the orientation typically used during operation, but as may be appreciated, bicycle exercise apparatus 100 may include a lockout mechanism, not shown, that prevents frame 102 from moving about the suspension mounting points during operation, resulting in a simulation of a traditional stationary exercise bicycle.

In addition, the present design may optionally involve transport wheels 210 to facilitate moving the apparatus, brake cables 211 and handbrake 212 to provide control of the rotational speed of flywheel 108, and a tension adjustor mechanism 213, for controlling the amount of resistance applied at flywheel 108, by moving one or more brake pads against or away from the flywheel or similar friction device suitable for providing resistance to pedaling, while performing the spinning motion in accordance with the present design.

Front Mount

Figure 4:
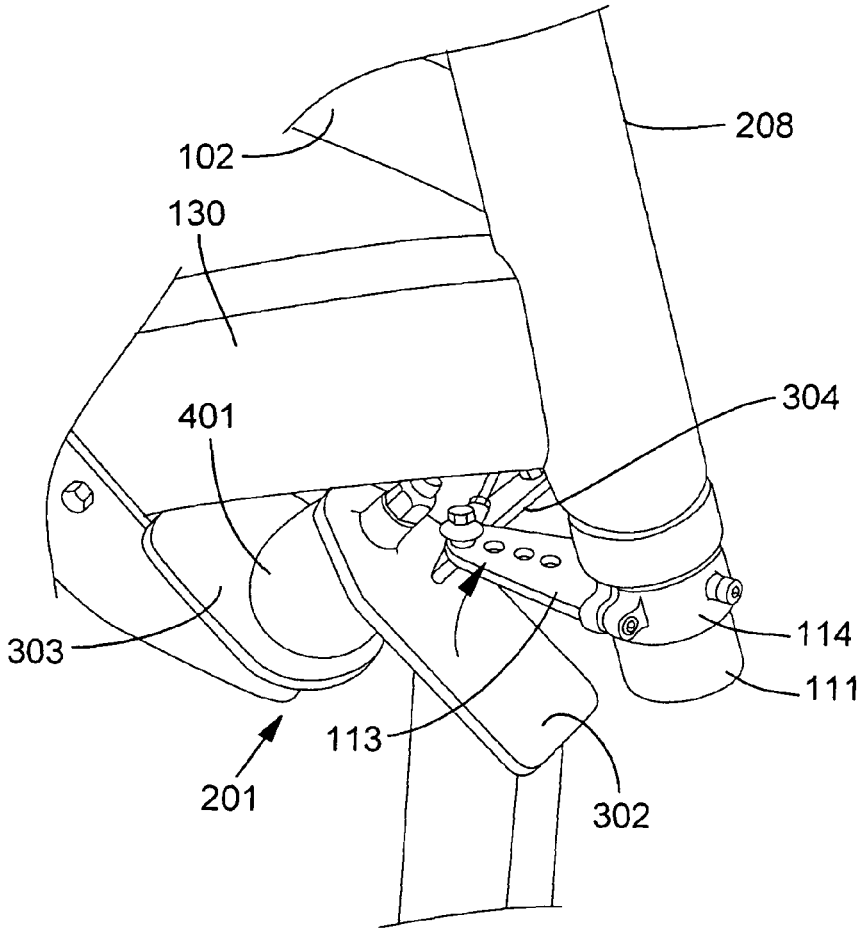
FIG. 4 is a close up view of the present design in a turning position illustrating the first mount front suspension point mechanism in accordance with the embodiment shown.
Figure 5:
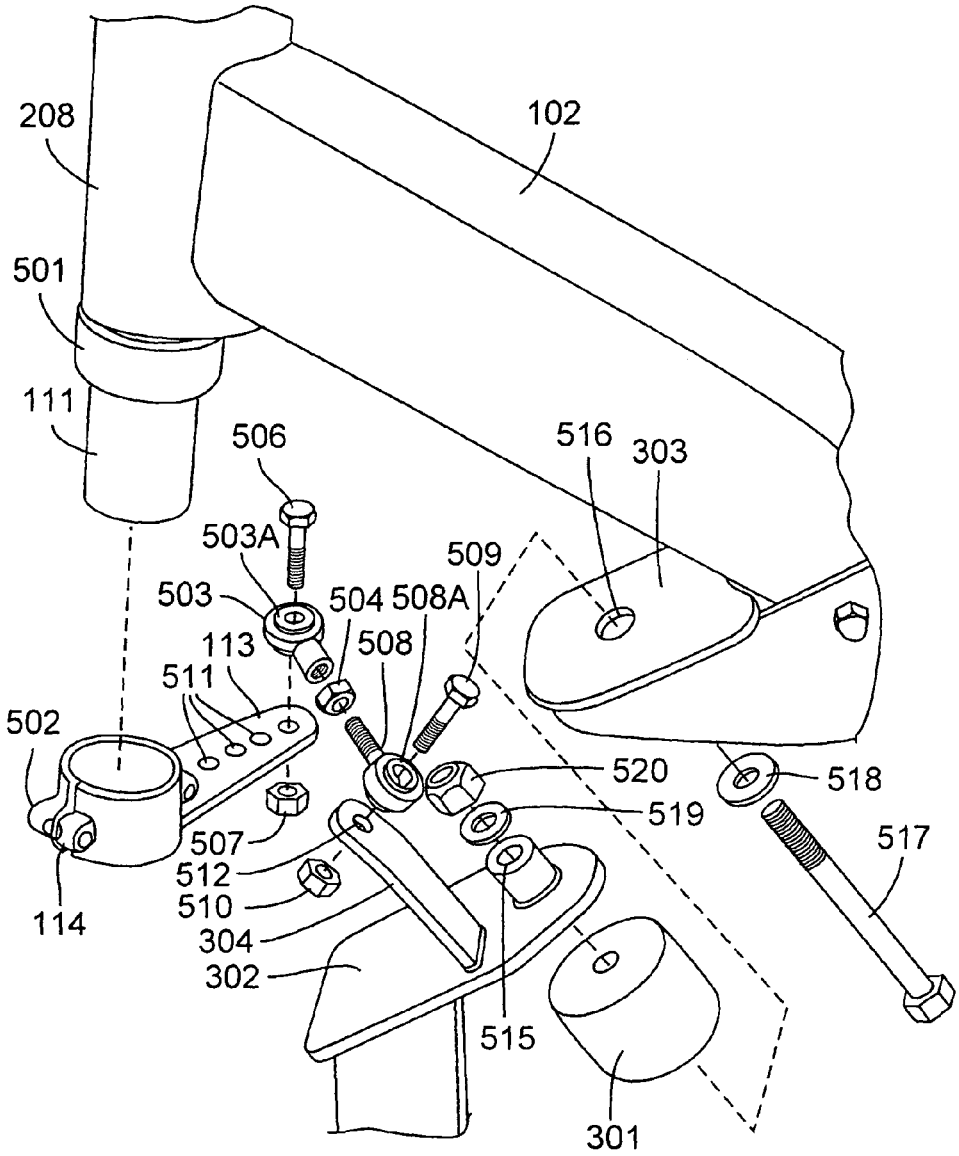
FIG. 5 is an exploded view of first mount suspension design illustrating many of the components in FIGS. 3 and 4 at an alternate perspective viewing angle.

Various views of the front mount 103 are illustrated in FIGS. 3, 4, and 5. FIG. 3 illustrates front mount 103 in a resting or static position. FIG. 4 illustrates the user turning the handlebar and the resultant deformation impressed on the elastomer spring device at front mount 103. An exploded parts view and assembly schematic of front mount 103 is illustrated in FIG. 5.

FIG. 3 is a close up view illustrating the first mount suspension mechanism involving an elastomer spring 201 device attached to a steering input assembly employable with the present design. The first mount 103 typically employs an elastomer material 301 and is positioned between a top plate 302 and bottom plate 303. In general, the elastomer material may be aligned and positioned between the top and bottom plates by means of a thru-bolt simply affixing them in place or other means suitable for holding the elastomer material and top and bottom plates in place.

The top plate 302 illustrated in FIG. 3 may attach the first mount 103 to a stationary frame section 105, typically by welding section 105 to the bottom-side of top plate 302. In addition, top plate 302 may include a fixed arm 304, where one end of the fixed arm may be welded or glued or otherwise attached to the top side of top plate 302. The other end of fixed arm 304 may provide at least one mounting hole 305. The mounting hole 305 may permit a connecting rod 306 to be fitted between fixed arm 304 and swing-arm 113 device. The present design may permit changing the length of connecting rod 306 using a threaded sleeve configuration as shown and may be fastened to swing-arm 113 and fixed arm 304 using a bolt, nut washer arrangement or other fastening device suitable for attaching the connecting rod in accordance with the present design. The present design may permit changing the effective length of swing-arm 113 by positioning and fastening the connecting rod 306 over one of a plurality of holes at 310 located at differing distances from the center of stem 111 as shown in FIG. 3. Changing the effective length of swing-arm 113 may modify the amount of deformation realized by the elastomer spring 201 device, thus increasing or decreasing the amount of force generated by rotating handlebar 110. In addition, changing the effective length may alter the handlebars' overall range of movement in relation to the movement of frame 102.

The bottom plate 303 illustrated in FIG. 3 may attach the first mount 103 to a tube element used to form frame 102, shown connected to a bottom tube 320 frame element, typically by welding a mounting bracket 307 to the bottom side of bottom plate 303 and using a fastener, for example a bolt, nut, and washer arrangement, to mate and attach mounting bracket 307 to frame 102 bottom tube 320 frame element. Although illustrated using a bolt, nut, and washer arrangement, mounting bracket 307 may be connected to the bottom tube by welding or other means sufficient to secure the mounting bracket to the frame element.

The elastomer material 301, top plate 302, and bottom plate 303 are each configured with a mounting hole to accept a fastener arrangement, for example a bolt, nut and washer combination, for attaching first mount 103 to the stationary frame 101 and the frame 102. Note that the mounting holes are not visible in this view.

FIG. 4 is a close up view of the present design in a turning position illustrating the first mount front suspension point mechanism involving an elastomer spring 201 device attached to a steering input assembly. As previously described, the present design may transfer rotational movements at handlebar 110, in either a left or right turning position, by moving swing-arm 113 in proportion to the handlebar 110 movements. FIG. 4 illustrates the current design executing what might be termed a "right turn," or the rider leaning to his right.

Connecting rod 306 may transfer these rotational movements to fixed arm 304 and may partially deform elastic material 301. The amount of deformation exhibited at point 401, representing the joint or junction or intersection between elastic material 301 and bottom plate 303 is directly related to the hardness or stiffness of the elastic material, the tightness or torque applied to first mount 103 fastening bolt, the length of connecting rod 306, length of swing-arm 113, and magnitude and direction of the force applied by the user at handlebar 110. The elastic material will dissipate some of the forces produced by moving handlebar 110, and altering these components, either in construction or measurement, can alter the operation of the device and the "feel" of the simulated riding experience.

Forces not dissipated by the elastomer material may remain within frame 102, resulting in turning of the bicycle. The present design may enable modifying the amount of horizontal and vertical offset generated, and thus tailoring the riding simulation experience by changing the hardness or stiffness of the elastic material, torque applied to first mount 103 fastening bolt, i.e. compression of the elastomer material, effective length of connecting rod 306, effective length of swing-arm 113, magnitude and direction of the force applied by the user at handlebar 110, and body mass positioning.

The present design generally does not afford changing the alignment axis 203 formed by the two mounting points without a materially different riding experience. However, it may be appreciated that changing the alignment axis 203 can change the riding simulation experience. In practice, experimentation has shown that an axis 203 angle of in the range of approximately 30 to 45 degrees from the horizontal, and in some circumstances 37 degrees, plus or minus eight degrees, measured relative to the two mounting points 103 and 104, produces a generally adequate simulation response while performing the bicycle exercise on bicycling exercise apparatus 100. Other angles may be employed and are highly dependent on a variety of factors including but not limited to the size and dimensions of frame 102, positions of pedals 106 and seat 115, and so forth, but operation in these ranges seems to provide an accurate riding simulation experience for most persons on a device reflected in this specific embodiment. In this configuration, the present design may permit users to perform bicycling exercises wherein the horizontal and vertical movements exhibited by the suspended bicycle frame within the stationary frame closely simulate operation of a conventional bike.

In addition, the present design may employ various elastomer materials to provide a method of progressive resistance when subjected to turning forces, where each material exhibits a different hardness in terms of durometers, to adjust the off-axis horizontal and vertical movements exhibited by frame 102 within the stationary frame, and may allow for adjusting the amount or degree of tilting, leaning, rolling, and yawing to improve the accuracy and realism of the bicycling exercise simulation. The term "durometer" is generally used to indicate the elastomer material's resistance to deformation, and the durometer of the elastomer material may be altered to create different riding qualities.

FIG. 5 is an exploded view of first mount 103 design illustrating many of the components in FIGS. 3 and 4 at an alternate perspective view angle. Referring to FIG. 5, stem 111 is shown protruding out of the bottom of headset collar 501 that is installed on frame 102 inside the head tube frame element as part of a typical headset assembly. The swing-arm 113 is illustrated with an integrated clamp 502 device that may permit fastening swing-arm 113 to stem 111 maintaining a fixed relationship.

In this embodiment, connecting rod 306 is used to attach swing-arm 113 to fixed arm 304 allowing connecting rod 306 to be shortened or lengthened. In this arrangement, the connecting rod 306 is shown to include two threaded eyebolts and a nut configured to increase or decrease the distance measured between the swing and fixed arms in accordance with the present design. The first threaded eyebolt is shown as a female eyebolt 503 component that supports internal bushing 503A at one end, e.g. elastomer, metal, plastic, etc., where bolt 506 may pass through the center of bushing 503A. Once passed through eyebolt 503 bushing 503A, bolt 506 may pass through the center of one a plurality of holes 511 located on swing-arm 113. After bolt 506 successfully passes through a hole in swing-arm 113, it may then pass through hole 512 and a nut 507 may be threaded onto bolt 506 securing the swing-arm to connecting rod 306 female eyebolt 503. Note that bushing 503A may permit eyebolt 503 to rotate concentrically around bolt 506 allowing a moveable pivot point in the horizontal direction at the junction formed at swing-arm 113 and connecting rod 306.

In this embodiment, female eyebolt 503 is shown with an internal tapped screw thread at the other end positioned to mate with male eyebolt 508. Male eyebolt 508 is shown with an external die screw thread positioned for assembly with female eyebolt 503. Installing adjustment locking nut 504 onto male eyebolt 508 prior to assembly with female eyebolt 503 may allow changing of connecting rod 306 effective length as measured between swing-arm 113 and fixed arm 304 by changing the position of adjustment locking nut 504 along the threaded shaft of male eyebolt 508. Locating adjustment locking nut 504 further toward male eyebolt 508 bushing 508A may shorten the connecting rod, and locating adjustment locking nut 504 further away from male eyebolt bushing 508A may lengthen the connecting rod. In other words, by turning the male eyebolt clockwise, or counter-clockwise, relative to the female eyebolt, the effective length of the connecting rod may be shortened or lengthened. The use and operation of eyebolts to form an adjustable length connecting rod should be well understood by those skilled in the art.

Continuing on, the second eyebolt is shown as male eyebolt 508 component that supports internal bushing 508A at one end, e.g. elastomer, metal, plastic, etc., where bolt 509 passes through the center of bushing 508A. Once passed through bushing 508A, bolt 509 passes through the center of hole 304A on fixed arm 304. After bolt 509 successfully passes through the hole in fixed arm 304, a nut 510 can be threaded onto bolt 509 securing the fixed arm 304 to connecting rod 306 male eyebolt 508. Note that bushing 508A may permit eyebolt 508 to rotate concentrically around bolt 509 allowing a moveable pivot point in the horizontal direction at the junction formed at fixed arm 304 and connecting rod 306. Furthermore, the moveable pivot point formed by bushing 508A, eyebolt 508, and bolt 509 may exhibit a small amount of vertical rotation, as typically exhibited by ball joint designs, allowing a moveable pivot point in the vertical direction.

Fixed arm 304 is illustrated fastened to top plate 302 using welds, glue, or other methods (not shown) to secure the two components in place. The top edge of elastomer material 301 may be located on the bottom side of top plate 302 and positioned over mounting hole 515. In a similar manner the bottom edge of elastomer material 301 may be located on the topside of bottom plate 303 positioned over mounting hole at 516. When the above components are aligned, a bolt 517 may pass through washer 518, mounting hole 515, elastomer material 301, mounting hole 515, washer 519, and ultimately fastened with nut 520.

Note that top plate 302 is attached to a section 105 used to construct stationary frame 101, and bottom plate 303 is attached to a top tube frame element used to construct frame 102.

Operation

FIG. 6 is a right side perspective view of a user riding the device and spinning the pedals in a right-turn position by simultaneously applying a complex steering input force at the handlebars, seat, and pedals to lean, tilt and rotate the bicycle frame. FIG. 6 illustrates the stationary frame, bicycle frame, driveline, steering, seating, and mounting point assemblies used to construct the present design. Each assembly has been described previously.

FIG. 6 illustrates rider 600 making a right turn on the bicycling exercise apparatus 100, with the frame 102 pivoted about mounting points 103 and 104. The handlebars 110 turn or rotate clockwise as shown by arrow 601, while the frame 102 pivots as shown by arrow 602. As shown, rotation at the handlebars rotates adjustable collar 114 and may allow connecting rod 306 to push against fixed arm 304. In this arrangement, bicycle frame 102 may rotate about axis 203 and lean to the right. The result is movement in the direction of the arrows shown, pivoting about front mounting point 103 and rear mounting point 104 about axis 203 as shown by arrow 603. Such an ability to lean or articulate the bicycle frame about the two mounts provides a unique experience, particularly as measured against previously available stationary or spinning bike designs.

Thus in operation, a user may employ the present design by first standing on a pedal and mounting the frame 102 and sitting on the seat. The user may begin by simultaneously spinning the pedals, balancing the bicycle frame, turning the handlebars to steer, and leaning on the seat to steer in a standing position, as shown in FIG. 6, or in a seated position. The user may at some point lean to the right or left by a desired amount, at which time the device tilts to the side, including the seat, as the frame 102 pivots about first mount 103 and second mount 104. As may be appreciated, stationary frame 101 sections 105 as shown in FIGS. 1 and 3 are fixed in this embodiment, as is plate 302, and bicycle frame 102, including mounting bracket 307, tilt accordingly. As a result of this tilting, the present design causes the handlebar stem 111, affixed to swing arm 113, bolt arrangement 306, and fixed-arm 304, to provide a level of rotation of the handlebars due to the moment arm created. In other words, tilting of the frame 102 results in rotary force applied to stem 111, thereby turning the stem and the handlebars attached thereto. The result is the handlebars turning in an appropriate direction when leaning such that the rider can ride without placing her hands on the handlebars and cause the handlebars to turn or pivot. Typically, the user places their hands on the handlebars and actively rotates the handlebars to lean and position bicycle frame 102.

The present design is set to generally create balancing points in terms of body mass position and angle of axis 203. Too little resistance can cause even slight leaning to result in a rapid tilting to one side, potentially resulting in the user falling from the bicycle. Too much resistance can inhibit the rider's ability to lean. In general, the rider has a body mass center position, and that center position is accounted for when either sitting up or leaning forward and holding handlebars to provide the turning sensation with respect to the axis. Alteration of the dimensions of the present design can result in changes to the tilt-to-turn ratios, where the present bicycle frame articulation provides a turning response and tilting of the frame 102.

Application of pressure or torque to the handlebars in the present design can cause the bicycle frame to tilt, particularly when the rider is off the bike, due to the handlebar turning apparatus including swing-arm 113 and adjustable collar 114. The more practical application of this feature is that a rider may be able to "lean into" a turn, both leaning his body and applying pressure to the handlebars, thereby causing the turning or leaning configuration described more rapidly due to added force being applied via the handlebars. Further, the seat 115 may receive pressure from the thighs or buttocks of the rider and such pressure may augment the tilting of the bicycle design by applying torque above the axis 203.

The handlebars of the embodiment of FIG. 1 are affixed via adjustable collar 114 and swing-arm 113, but these components can be omitted or disconnected, resulting in the handlebars twisting freely or being fixed, such as welded to tubing elements 130. The combination of spinning pedals (driveline) mechanics and steering input about axis 203 creates the sensation of movement or simulates bicycle riding using the present design. The present design provides a leverage point that is similar to a conventional bicycle, wherein polar moments and polar inertia are generated relative to body mass location and angle axis. The user, when leaning, can right himself or return himself to a center or neutral position relatively easily with the current design due to the relationships between components and the resistive forces, such as those generated in conjunction with the elastomer 301.

Placement of the mount points 103 and 104 depends on the desired performance, the components employed, and the position of axis 203. In general, placement of axis 203 can be considered a placement relative to the rider that substantially approximates the placement or position of a front wheel on a conventional bicycle.

Figure 7A:
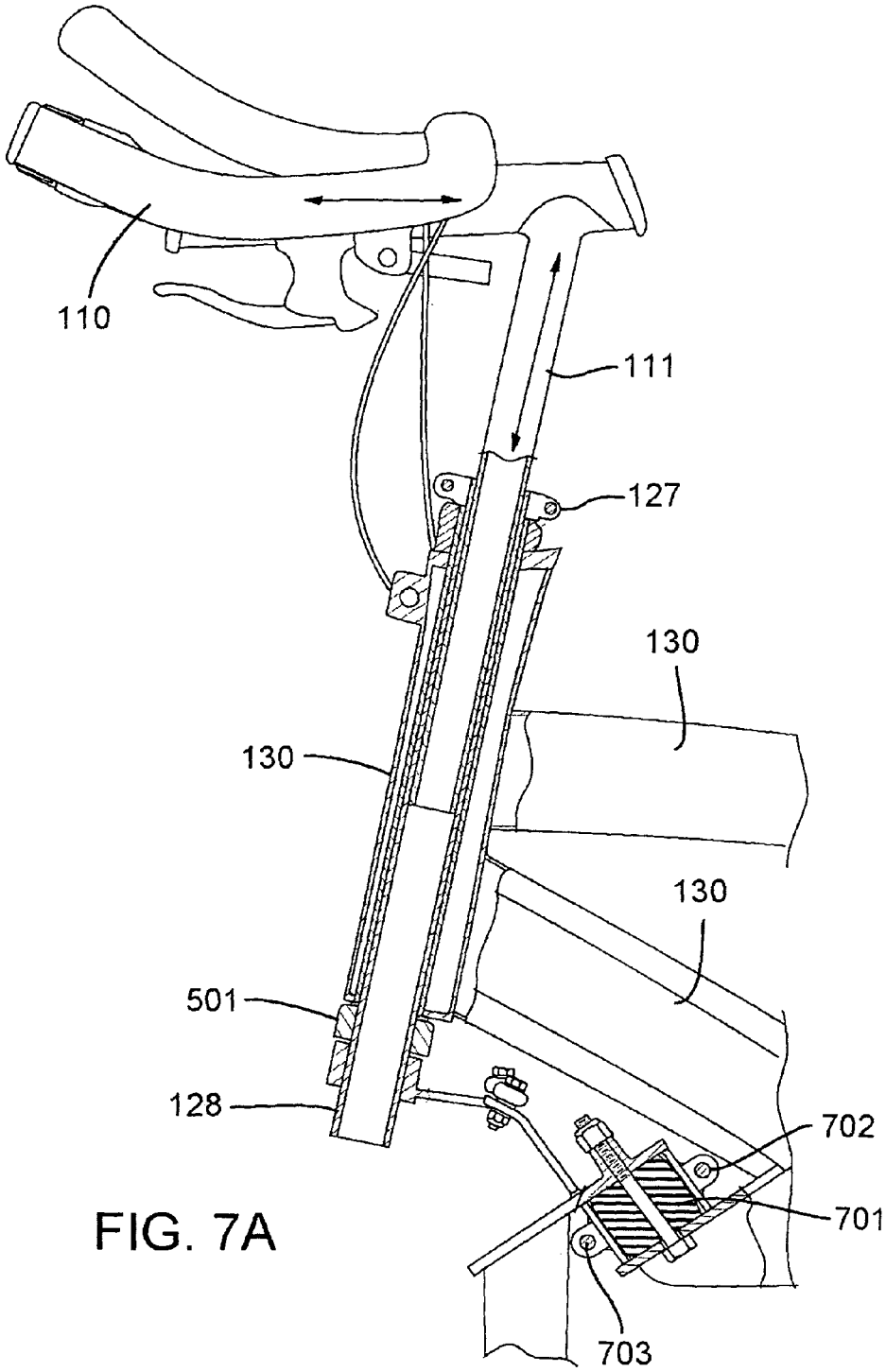
FIG. 7A is a close view illustrating the lockout mechanism associated with a first mount front suspension point employable with the present design.
Figure 7B:
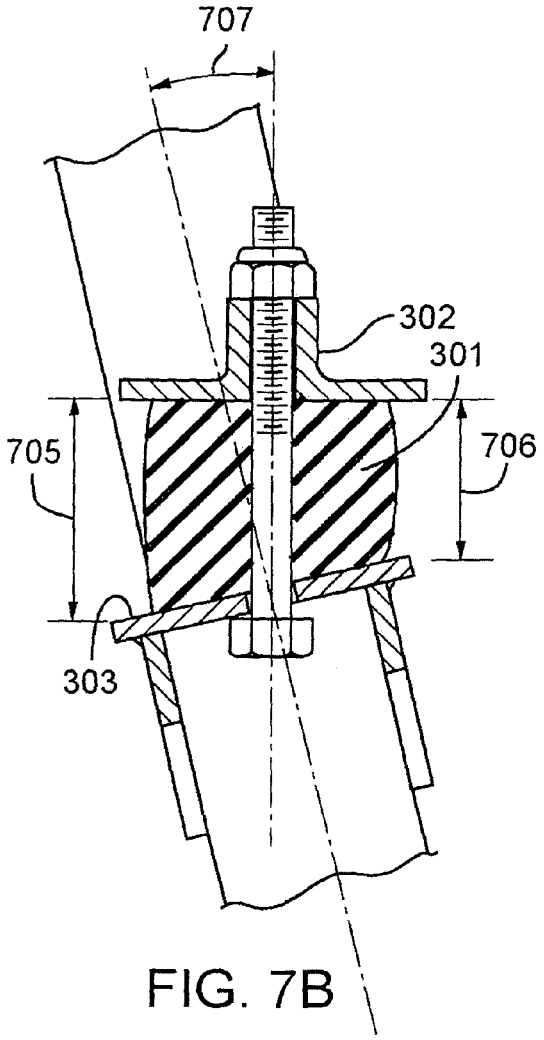
FIG. 7B is a close view illustrating deformation of the first mount front suspension point when the lockout mechanism is not present in accordance with an aspect of the present design.
Figure 7C:
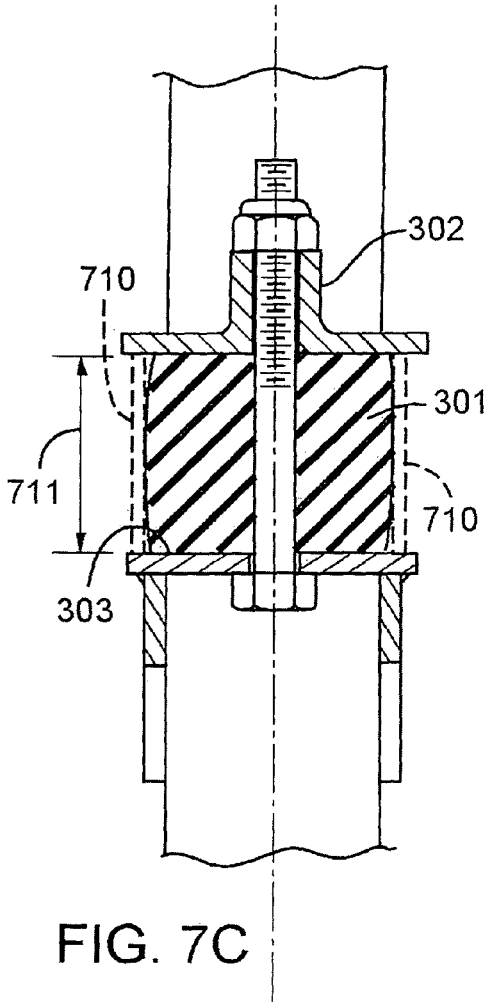
FIG. 7C is a close view illustrating no deformation of the first mount front suspension point when the lockout mechanism is present in accordance with an aspect of the present design.

FIGS. 7A, 7B and 7C illustrate a 'steering' or handlebar lockout mechanism for use with the present design.

FIG. 7A is a close view illustrating a lockout mechanism associated with a first mount front suspension point involving an elastomer spring 201 device attached to a steering input assembly and a pinch bolt device employable with the present design. In general, the pinch bolt device may be positioned to fix the geometrical relationship, i.e. remain essentially parallel, formed between the top and bottom plates that mate with elastomer spring 201 sufficient to prevent spring deformation in accordance with one aspect of the present design. The pinch bolt device may be constructed out of steel, or other materials sufficient to prevent spring deformation. FIG. 7A illustrates one embodiment for a lockout mechanism involving one half of a two-piece cylindrical collar at 701 configured with two bolts at 702 and 703 for attaching the two pieces together to form a solid fixed collar. In the 'locked-out' position, the present design may fix the steering input assembly sufficient to prevent the user from turning the handlebar 110 and may prevent any leaning of frame 102.

Setting the lockout mechanism to the 'locked' position, the steering input assembly, frame, and other components may exhibit a small amount of movement due to materials flexing and device assembly tolerances employed. This small amount of movement may provide a suspension mechanism in the locked-out position, i.e. the present design may combine the suspension mechanism with a stationary spinning bike emulation, i.e. no steering input from the user. The combination of a suspension mechanism with a stationary spinning bike is not available in today's completely rigid stationary designs.

The present design may include a mechanism for completely locking or completely releasing frame 102 to provide a rigid stationary bike or bicycling exercise apparatus 100 experience, respectively. Referring back to FIG. 1, a pin or rod device (not shown) attached to seat tube 209, for example, may drop down through a sleeve between pedals 106 and be inserted into a hole located in section 105. Inserting the pin into the hole completely locks the frame and may fix frame 102 sufficient to emulate a typical stationary bike. Retracting the pin device from the hole located in section 105 allows frame 102 to rotate about axis 203 in accordance with the present design. Configuring the pin device between the pedals may eliminate potential interference when the frame is completely released and able to move. In the preferred embodiment, the pin device would be attached on frame 102 as far away from front mount 103 as practical to reduce stress applied to frame 102 when completely locked. Other locking mechanisms that in essence lock or inhibit the rotation of the frame may be employed.

FIG. 7B is a close view illustrating deformation of the first mount front suspension point during use of bicycling exercise apparatus 100 when configured in the "un-locked" position. In the unlocked position, the user may apply forces at the pedals, seat, and handlebars sufficient to deform elastomer spring 301 as illustrated in FIG. 7B. Elastomer deformation may change the distance between top plate 302 and bottom plate 303 when examined at point 705 compared to the distance measured at point 706. In this example, the distance at point 705 is greater than the distance at point 706, the bicycling exercise apparatus 100 is leaning due to elastomer spring 301 deforming under user applied dynamic forces. FIG. 7B illustrates the frame 102 leaning or tilting by some amount at point 707.

FIG. 7C is a close view illustrating no deformation of the first mount front suspension point during use of bicycling exercise apparatus 100 when configured in the "locked" position. In the locked position, a cylindrical collar 710 is positioned and configured to maintain the "resting" or "static" shape of the elastomer spring. The lockout mechanism maintains top plate 302 and bottom plate 303 in a fixed parallel arrangement when present or "locked". When configured in the "locked" position bicycling exercise apparatus 100 maintains a constant distance between the plates at point 711.

Figure 8A:
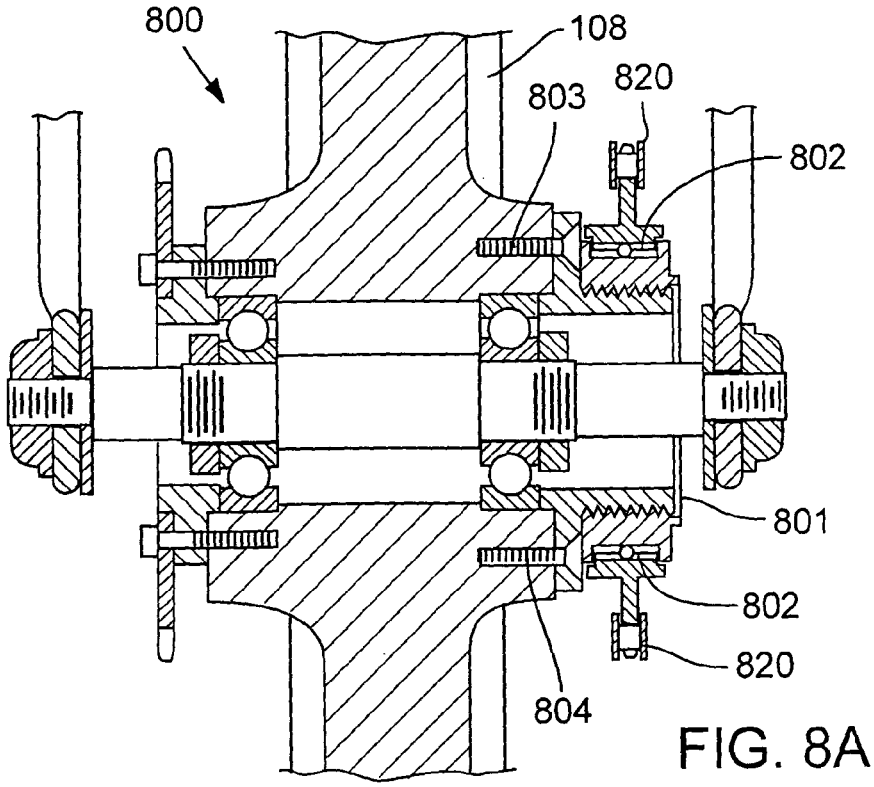
FIG. 8A is a close up view illustrating a reversible flywheel device involving a free-wheel mechanism.
Figure 8B:
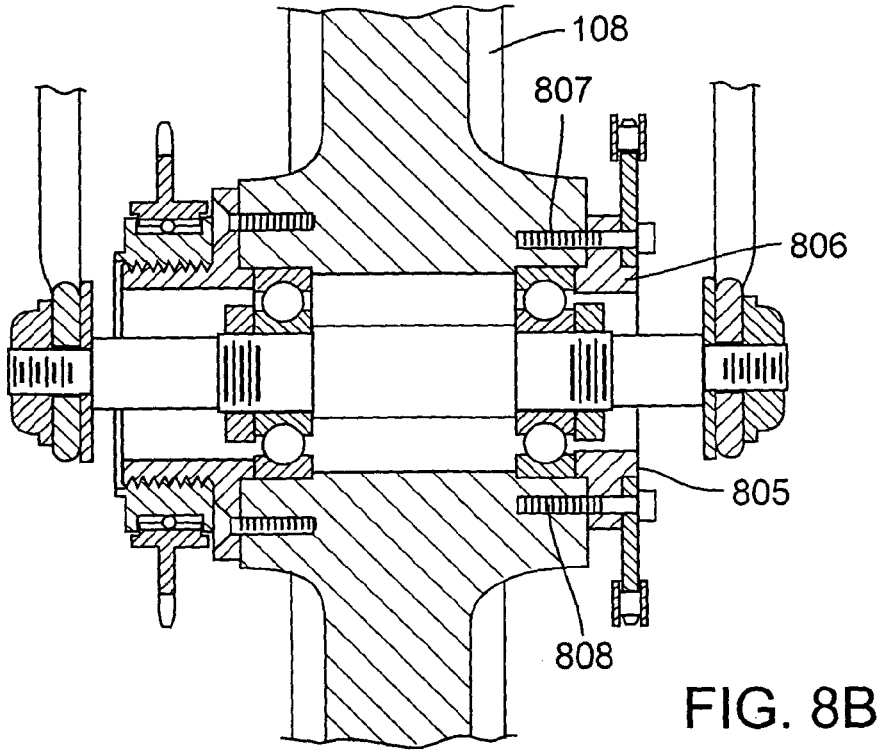
FIG. 8B is a close up view illustrating a reversible flywheel device involving a direct-drive mechanism.

FIGS. 8A and 8B illustrate a cross sectional view of a reversible flywheel device configured to provide a free-wheel sprocket arrangement on one side and a direct-drive sprocket arrangement on the other side. The user may select the desired driveline arrangement by aligning either the free wheel or direct-drive sprocket portion of the reversible flywheel with pedals 106 and placing the chain 820 over the sprockets to connect the pedals to the flywheel.

FIG. 8A is a close up view illustrating a reversible flywheel device 800 involving a free-wheel mechanism 801 attached to a flywheel 108 arranged to operate the flywheel in accordance with the embodiment shown. Referring to the right hand side of FIG. 8A, free-wheel mechanism 801 may comprise a clutch-plate 802 arrangement attached to flywheel 108 using bolts at 803 and 804. The chain 820 is illustrated as going "into the page" at the top of the clutch-plate arrangement at 802 and illustrates the chain coming "out from the page" at the bottom of clutch-plate arrangement at 802. When the user operates the pedals and chain in a clockwise direction (as viewed from the right), the clutch-plates, or "dogs," are arranged to make contact and interfere sufficient to operate flywheel 108. Operating the pedals and chain in a counter-clockwise direction, the clutch-plates or dogs are arranged to not make contact and interfere sufficient to allow pedals 106 to spin freely without affecting flywheel 108.

FIG. 8B is a close up view illustrating a reversible flywheel device involving a direct-drive mechanism 805 attached to flywheel 108 arranged to operate the flywheel employable with the present design. Referring to the right hand side of FIG. 8B, direct-drive mechanism 805 may comprise a fixed-plate arrangement at 806 attached to flywheel 108 using bolts at 807 and 808. Chain 820 is illustrated as going "into the page" at the top of the fixed-plate arrangement at 806 and illustrates chain 820 coming "out from the page" at the bottom of fixed-plate arrangement at 806. Bolts at 807 and 808 may allow for continuous contact and engagement of flywheel 108 with fixed plate arrangement at 806 to move and operate as a single piece. When the user operates the pedals and chain in a clock-wise or counter-clockwise direction, the present design spins or rotates flywheel 108 in the same direction as the pedals and chain.

The design presented herein and the specific aspects illustrated are meant not to be limiting, but may include alternate components while still incorporating the teachings and benefits of the invention, namely a bicycling exercise apparatus enabling off axis horizontal and vertical movements by leaning, tilting and rotating a bicycle frame suspended from a fixed frame at two points for user to perform a conventional bike exercise simulation. While the invention has thus been described in connection with specific embodiments thereof, it will be understood that the invention is capable of further modifications. This application is intended to cover any variations, uses or adaptations of the invention following, in general, the principles of the invention, and including such departures from the present disclosure as come within known and customary practice within the art to which the invention pertains.

What is claimed is:

1. An apparatus permitting a user to perform a simulated bicycling exercise, the apparatus employing a base substantially defining a base plane when extended and comprising:

a frame;

a first upper rear mounting point and a second lower front mounting point configured to maintain the frame;

a seat connected to said frame and configured to support the user in a forward facing orientation;

a wheel positioned in association with said frame;

a pair of pedals configured to interact with said wheel; and wherein said frame is configured to pivot about the first upper rear mounting point and second lower front mounting point in response to leaning by the user;

wherein the first upper rear mounting point and second lower front mounting point form a nonadjustable axis angularly displaced from the base plane in a range between approximately 30 to 45 degrees intersecting at a point forward of the pedals.

2. The apparatus of claim 1, the frame is able to rotate about the axis formed by the first upper rear mounting point and the second lower front mounting point.

3. The apparatus of claim 1, wherein the second lower front mounting point further comprises a resistive element, the resistive element configured to absorb, distribute and dissipate turning forces applied by the user at the seat and pedals.

4. The apparatus of claim 1, further comprising a resistive element associated with the second lower front mounting point.

5. The apparatus of claim 1, further comprising a handlebar piece configured to receive turning force from the user and cause said frame to pivot about the axis formed by the first upper rear mounting point and second lower front mounting point in response.

6. The apparatus of claim 5, wherein turning the handlebar piece generates a steering effect while the user applies force to the pedals.

7. The apparatus of claim 1, wherein the second lower front mounting point comprises a tensioning/return device configured to support the frame and permit the user to lean and tilt the frame while applying force to the pedals.

8. The apparatus of claim 6, wherein the tensioning/return device is configured to return the frame to a neutral orientation and deforms to permit movement of the frame.

9. The apparatus of claim 1, wherein at least one of the first mounting point and second mounting point comprises a pivoting device configured to suspend the frame, thus permitting the user to lean.

10. The apparatus of claim 1, further comprising a lockout mechanism preventing frame pivoting.

11. The apparatus of claim 1, wherein the wheel and pedals are fixed in a direct drive manner.

12. The apparatus of claim 1, wherein the wheel and pedals are freewheeling thereby enabling reverse pedaling with no resistance applied to the wheel.

13. The apparatus of claim 1, wherein the wheel has attached thereto a sprocket configured to enable a direct drive mode and a freewheeling mode.

14. The apparatus of claim 2, wherein an acute angle is formed by the base plane and the axis when extended.

15. A method for enabling a user to perform a simulated bicycling exercise, comprising:

providing two mounting points defining an axis, the two mounting points comprising an upper rear mounting point and a lower front mounting point, each mounting point oriented at predetermined distances above a surface; and employing a frame with the two mounting points, the frame configured to receive forces from the user and dissipate the forces into frame leaning forces;

enabling the user, when facing forward, to operate pedals associated with the frame, said pedals associated with a wheel;

wherein the user has an ability to cause said frame to pivot about at least one mounting point by leaning to one side;

wherein the axis is nonadjustable and angularly displaced from the surface in a range between approximately 30 to 45 degrees, and wherein the axis when extended and the surface intersect at a point forward of the set of pedals.

16. The method of claim 14, wherein the frame is configured to pivot about the axis.

17. The method of claim 14, wherein the lower front mounting point comprises a resistive element configured to absorb, distribute and dissipate turning forces applied by the user at the pedals.

18. The method of claim 14, further comprising enabling the user to employ a handlebar piece configured to receive turning force from the user and cause said frame to pivot about the axis.

19. The method of claim 14, wherein one of the mounting points comprises a tensioning/return device configured to support the frame and permit the user to lean and tilt the frame while applying force to the pedals.

20. The method of claim 14, further enabling the user to prevent frame pivoting using a lockout mechanism.

21. The method of claim 14, wherein the wheel has attached thereto a sprocket configured to enable a direct drive mode and a freewheeling mode.

22. The method of claim 14, wherein the method employs a base substantially defining a base plane when extended, and the axis when extended intersects the base plane at a point forward of the set of pedals, and an acute angle is formed by the base plane and the axis when extended.

23. An apparatus for enabling a user to perform a simulated bicycling exercise, the apparatus employing a base that, when extended, substantially forms a base plane, the apparatus comprising:

a frame;

a higher rear mounting point and a lower front mounting point providing an axis, the higher rear mounting point and lower front mounting point configured to maintain the frame;

a pair of pedals and a wheel, wherein the pedals and wheel are attached to the frame and enable the user to perform a pedaling motion;

a seat for maintaining the user in a forward facing orientation; and resistive articulation hardware configured to enable the user leaning in a direction to cause pivoting of said bicycle frame about the axis in the direction of leaning;

wherein the axis is nonadjustable and angularly displaced from the base plane in a range between approximately 30 to 45 degrees intersecting at a point forward of the pedals.

24. The apparatus of claim 22, further comprising a handlebar arrangement configured to receive forces generated by the user and cause pivoting of said frame.

25. The apparatus of claim 22, wherein the wheel and pedals are fixed in a direct drive manner.

26. The apparatus of claim 22, wherein the wheel and pedals are freewheeling thereby enabling reverse pedaling with no resistance applied to the wheel.

27. The apparatus of claim 22, wherein the lower resistive articulation hardware comprises a tensioning/return to center arrangement configured to support the frame, provide resistance, and permit the user to lean and tilt the frame while applying force to the pedals.

28. The apparatus of claim 26, wherein the tensioning/return to center arrangement comprises an elastomer spring device configured to apply forces to the frame, at a forward location, and deform to permit movement of the frame.

29. The apparatus of claim 22, wherein said seat and pedals are configured to allow dynamic positioning of the user's body mass about said frame while maintaining balance and spinning the pedals.

* * * * *